United States Patent [19]

Dooley et al.

[11] Patent Number: 4,920,770

[45] Date of Patent: May 1, 1990

[54] VARIABLE ARC AGITATOR SYSTEM

[75] Inventors: Eddie W. Dooley, Jeffersonville, Ind.; Joseph R. Noland, Crestwood, Ky.

[73] Assignee: General Electric Company, Louisville, Ky.

[21] Appl. No.: 374,844

[22] Filed: Jul. 3, 1989

[51] Int. Cl.[5] ..... D06F 17/08

[52] U.S. Cl. ..... 68/133

[58] Field of Search ..... 68/131, 133, 134

[56] References Cited

U.S. PATENT DOCUMENTS

| | | | |
|---|---|---|---|
| 2,273,566 | 2/1942 | Faber | 68/133 |
| 3,213,651 | 10/1965 | Worst | 68/133 |
| 3,388,570 | 6/1968 | Cobb et al. | 68/134 |
| 3,511,067 | 5/1970 | Matzen | 68/23.7 |
| 4,170,882 | 10/1979 | Brenner et al. | 68/133 |
| 4,325,234 | 4/1982 | Toma | 68/133 |

*Primary Examiner*—Philip R. Coe

*Attorney, Agent, or Firm*—Radford M. Reams; H. Neil Houser

[57] ABSTRACT

An adjustable agitation system for an automatic washing machine includes a lost motion fluid drive connection between the input drive member and the agitator so that agitator oscillates through a lesser arc than the input drive member. The fluid drive is formed by pockets in the agitator skirt and corresponding paddles on the drive member skirt. The spacing of the drive member and agitator is varied to vary the differential between the drive member oscillation arc length and the agitator oscillation arc length. A connection member engages the input drive member and is selectively engageable with the agitator to connect the input drive member and agitator for conjoint oscillation.

19 Claims, 4 Drawing Sheets

VARIABLE ARC AGITATOR SYSTEM

BACKGROUND OF THE INVENTION

The invention relates to automatic fabric washing machines of the vertical axis type and, more particularly, to an adjustable drive system for oscillating the agitator through a variable arc.

It is often desirable to be able to select different levels of energy input into a fabric or clothes washing machine. In the past variable energy input commonly was accomplished by the use of a multi-speed motor or by a multi-speed clutch connected between a single speed motor and the agitator. Both such approaches are relatively expensive and require complicated control circuitry for selecting the desired input speed. Other commercially available washing machines have multiple agitators. Generally a "regular" agitator is nested over a "gentle" agitator and effects the washing action. Upon removal of the regular agitator the smaller, gentle agitator effects a lower energy washing action.

Some prior art patents, such as U.S. Pat. Nos. 3,388,570 and 3,511,067 for example, show and describe agitator mechanism in which the exposed area of the agitator vanes in varied. Typically this is accomplished by varying the length of vane exposed to the liquid and fabrics in the machine. U.S. Pat. No. 3,213,651, assigned to General Electric Company, assignee of the present invention, discloses the use of a spring loaded mechanism connected between an input member and the agitator. As the input member is oscillated, the agitator oscillates only after the associated spring is fully compressed. U.S. Pat. No. 4,325,234, also assigned to General Electric Company, discloses a machine including a drive shaft oscillatable about a first axis and an agitator oscillatable about a second axis. A plurality of selectably engageable finger and slot arrangements oscillate the agitator through a selected one of a plurality of arcs in response to oscillation of the drive shaft through a predetermined arc.

Some of the mechanical arrangements for varying the energy input are relatively complicated while others place relatively large pressures on fairly small mechanical parts. None of these arrangements is totally satisfactory.

Therefore an object of this invention is to provide a new and improved agitation system for a washing machine.

Another object of this invention is to provide an improved agitation system in which the agitator may be driven through a shorter arc than the arc of the input drive member.

Yet another object is to provide such an improved agitation system in which a lost motion fluid drive is provided between the input drive member and the agitator.

Still another object is to provide such an improved agitation system in which the effectiveness of the lost motion fluid drive is selectably variable.

Another object of the present invention is to provide a new and improved agitation system for a washing machine in which the agitator selectively is connected to the input drive means for conjoint oscillation therewith and is disconnected from the input drive means.

SUMMARY OF THE INVENTION

In accordance with one form of the present invention there is provided an adjustable stroke agitation system for an automatic washing machine of the vertical axis type having a container to receive liquid and fabrics to be washed in the liquid. An elongated input drive member is oscillatable about a generally vertical axis and has an outwardly extending skirt positioned to be immersed in the liquid. An elongated agitator is mounted over and spaced from the drive member for oscillation about the vertical axis. The agitator includes an outwardly extending skirt spaced from the drive member skirt and positioned to be immersed in the liquid. One of the skirts has arcuately extending recess means facing the other skirt, which has generally radially extending paddle means received in the recess means and spaced from the one skirt. Oscillation of the input drive member causes relative motion between the recess and paddle means to oscillate the agitator through a shorter (smaller) arc.

In accordance with another aspect of the invention an adjustment member is mounted between the drive member and the agitator and is effective selectively to move the agitator longitudinally relative to the drive member for varying the spacing between the paddle and other skirt for varying the agitator oscillation arc length upon drive member oscillation of a predetermined arc length.

In accordance with yet another aspect of the present invention the drive member and adjustment member have a longitudinally splined joint for conjoint oscillation and relative longitudinal movement. The agitator has a toothed section. An intermediate member is positioned between the adjustment member and the agitator and has a toothed section. The adjustment member and the intermediate member have a longitudinally splined joint for conjointing oscillation and for relative longitudinal movement between one position of the intermediate member in which the toothed sections are engaged for conjointing oscillation of the drive member and agitator and another position of the intermediate member in which the toothed sections are disengaged.

DESCRIPTION OF THE PREFERRED EMBODIMENTS

Figure 1:
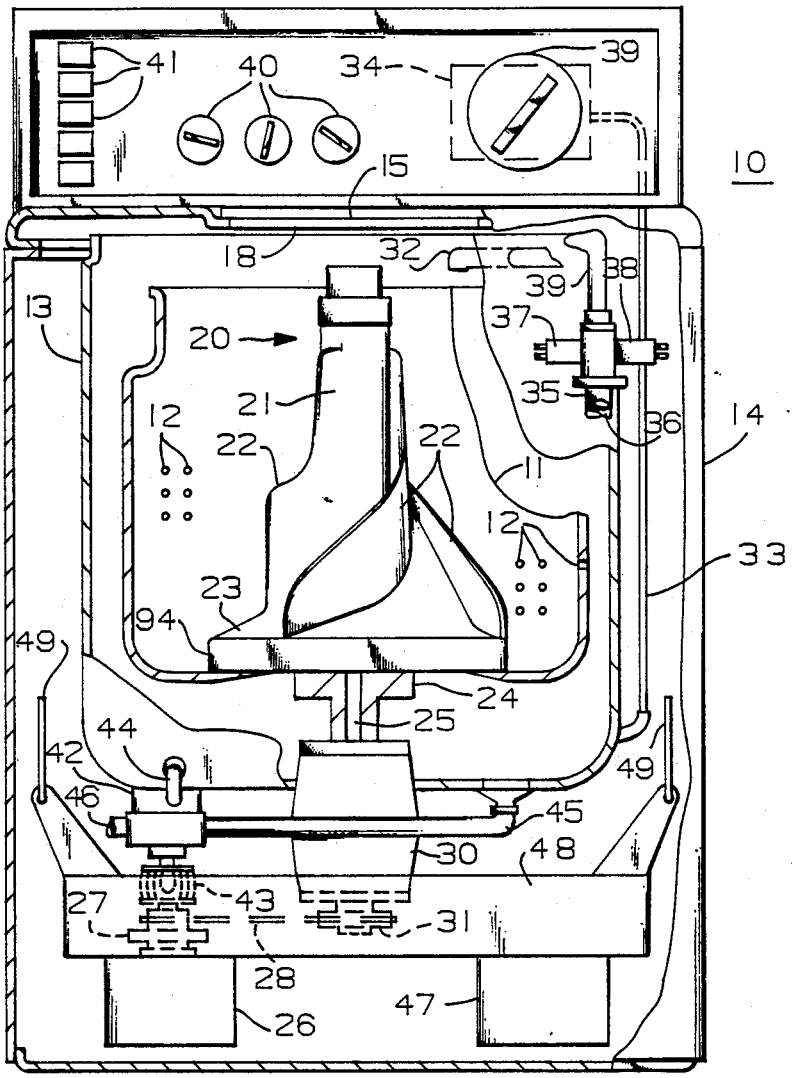
FIG. 1 is a schematic front elevational view of a fabric washing machine incorporating one embodiment of the present invention, the view being partly broken away, partly in section and with some components omitted for the sake of simplicity.

Referring now to the drawings, particularly to FIG. 1, there is shown an agitator type clothes washing machine 10 having a typical basket or clothes receiving receptacle 11 with perforations 12 in its side and bottom walls and disposed within an outer imperforate tub 13. Tub 13 is mounted within an appearance cabinet 14, which includes a cover 15 hingedly mounted in the top of the cabinet to provide access through an opening 18 to the basket 11. An agitator 20, positioned at the center of the basket 11, includes a center post 21 and a plurality of water circulating vanes 22 joined at their lower ends by an outwardly flared skirt 23. As will be discussed hereinafter in more detail, the agitator 20 is oscillatable about a generally vertical axis.

Both the fabric receiving basket 11 and the agitator 20 are rotatably mounted. The basket 11 is mounted on a flange of a rotatable hub 24 and the agitator is mounted on a shaft 25 which extends upwardly through the hub and through the center post and is connected to the agitator center post to drive it. During a cycle of machine operation water and detergent are added to the tub 13 and, because of the perforations 12, also to the basket 11. The agitator 20 is oscillated back and forth on its vertical axis, that is in a horizontal plane within the basket 11, to wash the clothes or other fabrics contained in the basket. After a predetermined period of washing action the basket 11 and agitator 20 are rotated at high speed to extract centrifugally the washing liquid from the fabrics and discharge it to drain. Following the extraction operation a supply of clean water is introduced into the tub and basket for rinsing the fabrics and the agitator is again oscillated. Finally the basket is once more rotated at high speed to extract the rinse water. It will be understood that a one wash and one rinse operation has described for illustrative purposes only. Typical machines also may include pre rinses before the wash operation as well as more than one rinse step or cycle after the wash cycle.

The basket 11 and agitator 20 may be driven from any suitable power source. By way of example, they are shown as driven from a reversible motor 26 through a drive including a clutch 27 which is mounted on the motor output shaft. The clutch 27 allows the motor to start without a load and then accept the load as the motor comes up to speed. A belt 28 transmits power from the clutch 27 to a transmission assembly 30 through a pulley 31. Thus, depending upon the direction of motor rotation, pulley 31 of the transmission is driven in opposite directions. The transmission 30 is so arranged that it supports and drives both the agitator drive shaft 25 and the basket mounting hub 24. When the motor 26 rotates in one direction the transmission causes the agitator 20 to oscillate in a substantially horizontal plane within the basket 11. Conversely, when the motor rotates in the other direction, the transmission rotates the wash basket 11 and the agitator 20 together at high speed for centrifugal extraction of water from the fabrics.

A conduit 32 extends through the upper part of tub 13 so that suitable washing and rinsing liquid may be introduced in the desired quantities into the tub. The perforations 12 of the basket 11 cause the interior of the basket 11 to be in effective fluid communication with the tub 13 so that the level of liquid in both the basket 11 and tub 13 will be the same. Thus, suitable means provided in communication with the tub 13 will determine when the appropriate level of water has been reached in basket 11. In the illustrative machine this function is provided in a conventional manner by means of tube 33 which connects the bottom of tub 13 with a conventional pressure sensitive water level control 34. Typically the control 34 incorporates a switch which is operated in response to an increase in the air pressure within the conduit 33 as a result of compression of air by the rise in the level of water in the tub 13. Conventionally a dial 39 in used to adjust the control 34 so that the water supply will be terminated at different preselected levels of water within the tub 13.

Conduits 35 ad 36 are adapted to be connected respectively to sources of hot and cold water (not shown). The conduits 35 and 36 are connected to a valve structure including hot and cold solenoids 37 and 38. The valve is connected to a hose 39 which is positioned to discharge to the conduit 32. The washing machine also includes various conventional controls operated by a suitable means such as control knobs 40 and push buttons 41 respectively. Conventionally one of these controls will be utilized to determine the appropriate mixture of hot and cold water for a particular wash or rinse cycle. Depending on the energization of solenoids 37 and 38 by the temperature control and water level control 34 hot and/or cold water will pass through hose 39 and conduit 32 into the interior tub 13 until the level of the water in the tub is sufficiently high to cause the water control valve 34 to turn off whichever of solenoids 37 and 38 had been energized.

When motor 26 rotates to provide for washing or rinsing operations, that is when agitator 20 is being oscillated, the motor also drives a pump 42 through a flexible coupling 43 in the appropriate direction to extract liquid from the bottom of the tub 13 through a conduit 44 and to recirculate it back to the tub through a filter (not shown). When motor 26 rotates to spin the basket 11 for water extraction, the motor also operates the pump 42 in the opposite direction through the coupling 43 to withdraw water from the bottom of the tub 13 through the conduit 45 and to discharge it to drain through conduit 46.

The motor 26, transmission 30 and a counterweight 47 are all mounted on a support assembly 48 which is suspended within the appearance cabinet 14 by a system including cable 49.

Figure 2:
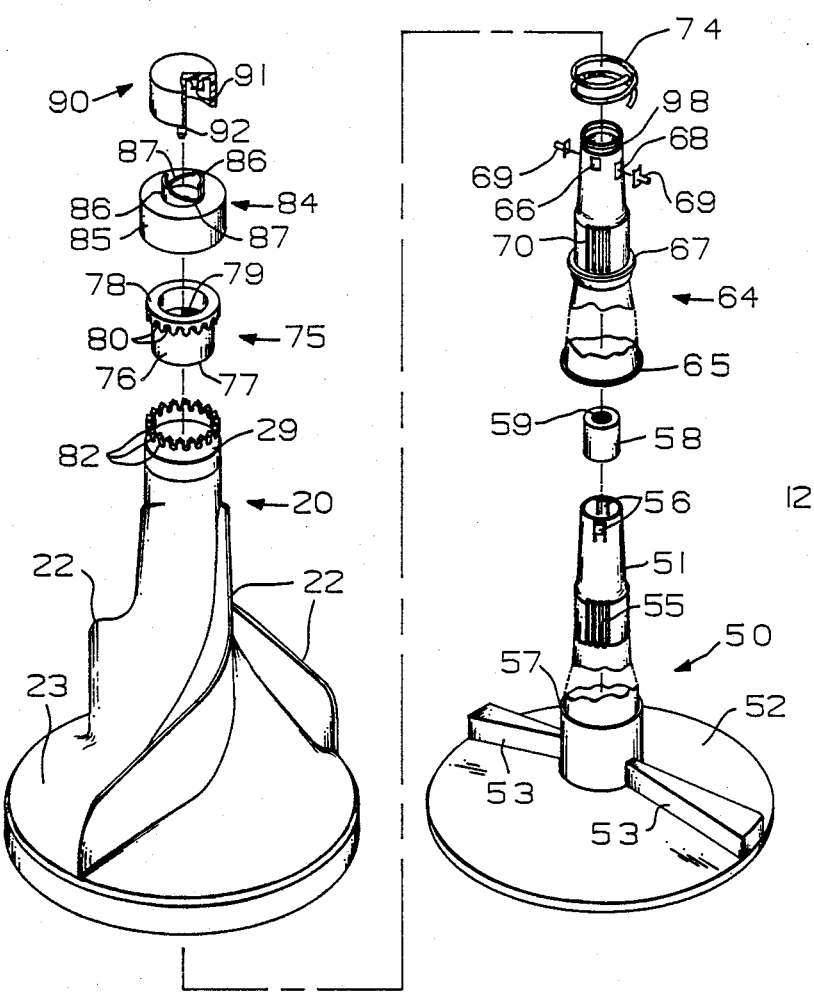
FIG. 2 is an exploded perspective view of various components of a variable arc agitator drive system incorporating one form of the present invention.
Figure 3:
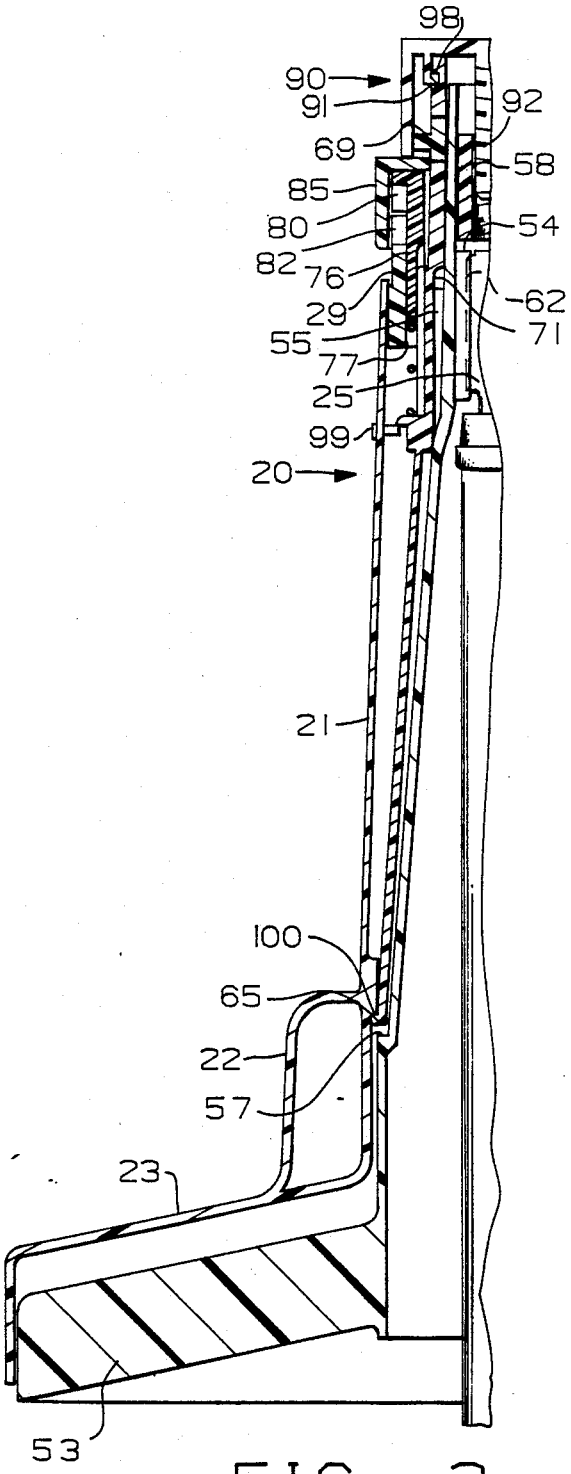
FIG. 3 is a partial cross-sectional view of the agitator drive system of FIG. 2, illustrating the agitator in a first longitudinal position relative to the input drive member.
Figure 4:
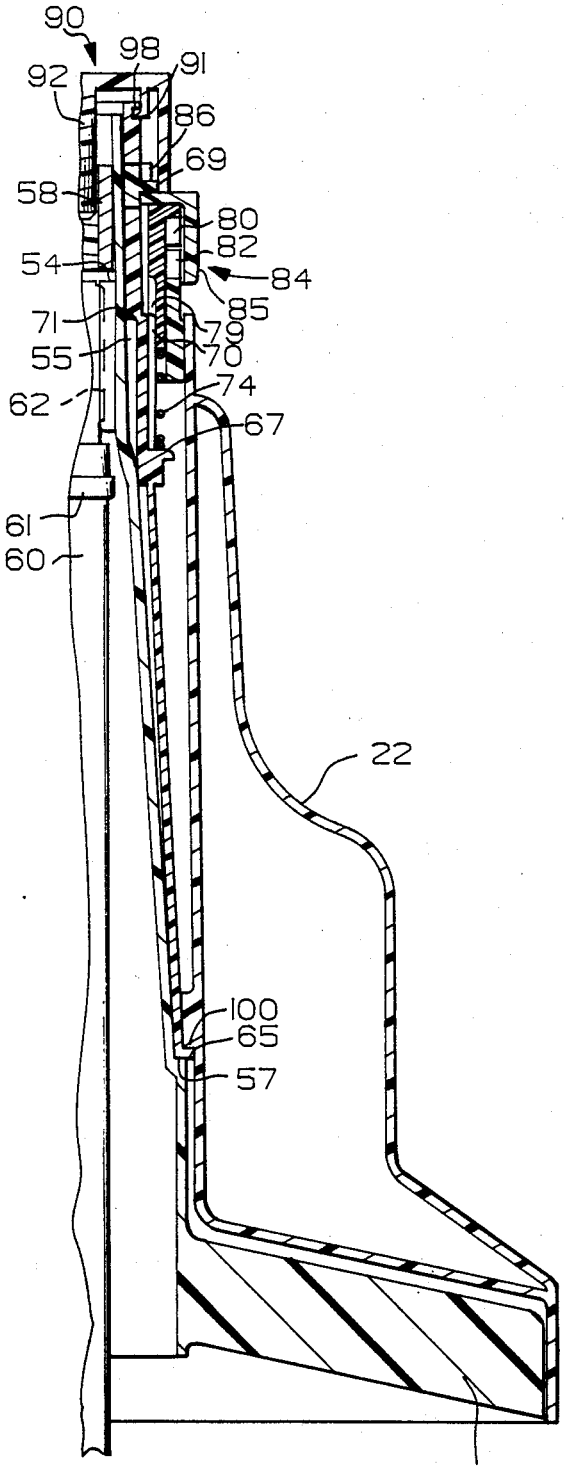
FIG. 4 is partial cross-sectional view of the agitator drive system complimentary to FIG. 3, but illustrating the agitator in a second longitudinal position relative to the input drive member.

Turning now particularly to FIGS. 2-5, there is shown an adjustable agitator drive arrangement in accordance one embodiment of the present invention. As best seen in FIGS. 3 and 4, the drive shaft 25 is supported within the basket 11 by a tube 60. The upper end of the shaft 25 extends out of the upper end of tube 60 and the opening therebetween is sealed by a combination bearing and seal 61. The upper end of the shaft 25 is provided with circumferentially disposed axially or longitudinally extending splines 62. As best seen in FIGS. 2-4, a drive or input member 50 includes a generally vertical centerpost 51 with an outwardly extending skirt 52 at its lower end. The skirt has a pair of oppositely disposed radially extending paddles or vanes 53 formed on its upper surface. Splines 54 are formed on the interior of the centerpost 51 and interfit with splines 62 on drive shaft 25. As will be explained more fully hereafter, the centerpost 51 also includes exterior longitudinal splines 55, a pair of resilient tabs 56 and a circumferentially extending ledge 57. Additionally a plug 58 is fixedly mounted inside the upper end of centerpost 51 and includes a threaded bore 59.

A generally frustoconical adjustment member 64 is formed to fit about the centerpost 51. A flange 65 is formed at the lower edge of the adjustment member and a pair of small rectangular openings 66 are formed adjacent its upper end. When the adjustment member 64 is placed over the centerpost 51 the flange 65 engages ledge 57 to limit relative downward movement of the adjustment member 64 while the resilient tabs 56 of the centerpost 51 snap into the openings 66 and thereafter limit upward movement of the adjustment member relative to the centerpost. The upper portion of adjustment member 64 also includes a pair of oppositely disposed pockets 68 into which pins 69 are snapped fit. The member 64 is formed with an intermediate ledge 67. Just above he ledge 67 the exterior surface of adjustment member 64 is provided with a series of longitudinally or axially extending splines 70 and the inner surface is provided with a series of longitudinally extending splines 71. A helical spring 74 is sized to fit about the adjustment member 64 with the lower end of the spring resting against the ledge 67.

An intermediate or connection member 75 has a generally cylindrical body 76 with a lower rim 77 and a upper edge 78. The plurality of longitudinally extending splines 79 are formed on the inner surface of the cylindrical body 76. The intermediate member 75 fits within the centerpost 21 of the agitator and around the outside of the adjustment member 64 with the lower rim 77 engaging the upper edge of the spring 74 and with the splines 79 slidably interleaved with the splines 70. A plurality of downwardly opening teeth 80 form a tooth section around the outside of the upper edge 78. An extension 29 at the upper end of the agitator centerpost 21 is formed with a cooperating plurality of upwardly opening teeth 82 forming a tooth section around the agitator. When the intermediate member 75 is pushed downwardly to compress the spring 74 the teeth 80 engage or interleave with the teeth 82.

A cap 84 includes a downwardly depending skirt 85 and an upwardly extending collar 86. The collar 86 is formed with a pair of oppositely disposed, complimentary ramps 87. An adjustment knob 90 includes an inwardly facing snap ring 91 and a downwardly extending threaded shaft 92.

Figure 6:
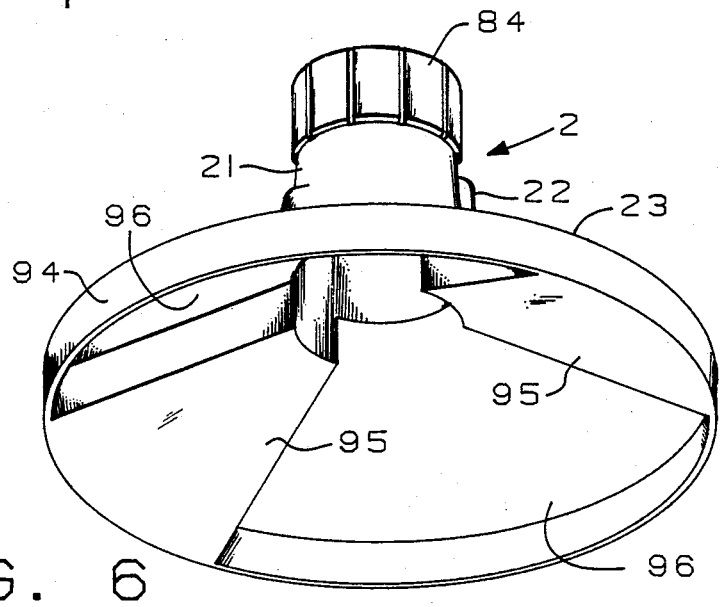
FIG. 6 is a somewhat schematic bottom perspective view of the agitator of FIG. 1.

Referring particularly to FIG. 6 it will be seen that the outwardly extending skirt 23 of the agitator 20 has a downwardly projecting lower flange 94 and a pair of downwardly extending lands 95 on the underside of the skirt 23. The flange and lands form a pair of oppositely disposed, arcuately shaped recesses 96. For purposes of illustration the agitator 20 is shown with two recesses 96 and the drive member 50 with two paddles 53. However, it will be obvious that other numbers of recesses and paddles may be provided so long as there is a recess in which each paddle fits and the size of the recesses is sufficient to accommodate the arcuate travel of the input member 50.

In assembling the illustrative agitator adjustable drive system, the drive member 50 is placed over the shaft 25 and support tube 60 with the splines 62 of the drive shaft 25 interfitting with the splines 54 of the input drive member 50. The adjustment member 64 is inserted over the drive member 50 until the resilient tabs 56 fit into the openings 66 and the flange 65 comes to rest on the ledge 57. The spring 74 is inserted about the upper end of adjustment member 64 and rests on ledge 67. The agitator 20 is placed over the drive member, adjustment member and spring with the paddles 53 being nestled within the recesses 96. The cylindrical body 76 of the intermediate member 75 is inserted into the upper end of the agitator so that its lower rim 77 rests against the upper edge of spring 74. Cap 84 is placed over the intermediate member 75 and is pushed downwardly to compress the spring 74 and bring the ramps 87 far enough down to expose the pockets 68 in the upper end of adjustment member 64. The pins 69 then are snapped into the pockets 68 so that they extend C outwardly and overlie the ramps 87. The adjustment knob 90 is placed into the top of the assembly and shaft 92 is screwed into the plug 58 inside of drive member 50. As the adjustment knob 90 is screwed downwardly the collar 86 on cap 84 is received between the snap ring 91 and the outside of the adjustment knob 90 and the snap ring 91 fits into an annular groove or recess 98 formed at the upper end of adjustment member 64. Finally pins or screws 99 may be inserted through the agitator centerpost 21 under the ledge 67 so that the agitator 20 will not rise around the adjustment member 64. Other means can be used to prevent the agitator from rising relative to the adjustment member. For example, flexible tubes can be formed on the inner surface of the agitator, positioned to fit under ledge 67.

Assuming that the pins 69 are at the lower ends of the ramps 87, the spring 74 will bias the intermediate member 75 and adjustment cap 84 to their upper positions and the teeth 80 will not engage in the teeth 82. When water is received in the tub 13 and basket 11 it fills the space between the drive member 50 and agitator 20 so that the paddles 53 within the recesses 96 form a lost motion fluid drive between the drive member 50 and agitator 20. As the input shaft 25 oscillates, it oscillates the drive member 50 through the connection between the splines 62 and 54 and the paddles 53 move within the recesses 96. Some of the fluid in each recess flows over and around the corresponding paddle from one side to the other. Additionally some water will flow outwardly between the peripheral edges of the skirts. This causes the agitator to oscillate, but at lesser speed and through a shorter arc than the arc of oscillation of the drive member 50. If desired, the paddles and recesses may be designed so that the paddles will abut against the lands 95 to form a solid mechanical drive toward the end of each oscillation. However, we have found it advantageous to size the paddles and recesses such that the full stroke of the paddle is just contained within the recess without contact between the paddle and the lands or with minimum such contact.

The amount of lost motion, that is the arc length of agitator oscillation relative to the arc length of drive member oscillation, is a function of how much of the water within the pockets can flow around the paddles as the paddles move within the recesses. The adjustment knob is used to adjust the vertical spacing between the agitator and the drive member and thus the size of the openings around the paddles. This adjusts the arc length of the agitator stroke relative to the arc length of the drive member stroke. When the knob 90 is rotated the engagement of shaft 92 with the threaded bore 59 in plug 58 causes the knob 90 to move up or down relative to the drive member, depending on the direction of rotation of the knob 90. Engagement of the snap ring 91 with the recess 98 moves the adjustment member 64 longitudinally or axially of the drive member 50. The engagement between splines 71 on the interior of the adjustment member 64 and the splines 55 on the exterior of the drive member 50 provide for this relative longitudinal movement while assuring that the drive member 50 and adjustment member 64 are always connected for conjoint oscillation. A ledge 100 formed on the inside of the agitator centerpost 21 rests on the flange 65 at the bottom of the adjustment member 64 and the pins or screws 99 have an interfering relation with the underside of ledge 67. Thus, as the adjustment member 64 is moved up and down by adjustment knob 90, it carries the agitator 20 with it. This adjusts the vertical spacing between the skirt 23 and the skirt 52. More particularly it adjusts the spacing between the top of the paddles 53 and the wall of skirt 23 forming the top of the pockets or recesses 96. This changes the ease with which water will flow over the paddles and thus provides the user with a means of adjusting the length and speed of the agitator stroke relative to the drive member stroke. FIG. 3 shows the adjustable drive system with maximum spacing between the paddle 53 and agitator skirt 23 while FIG. 4 shows the same assembly with a minimum vertical distance or spacing between paddle 53 and agitator skirt 23.

Figure 5:
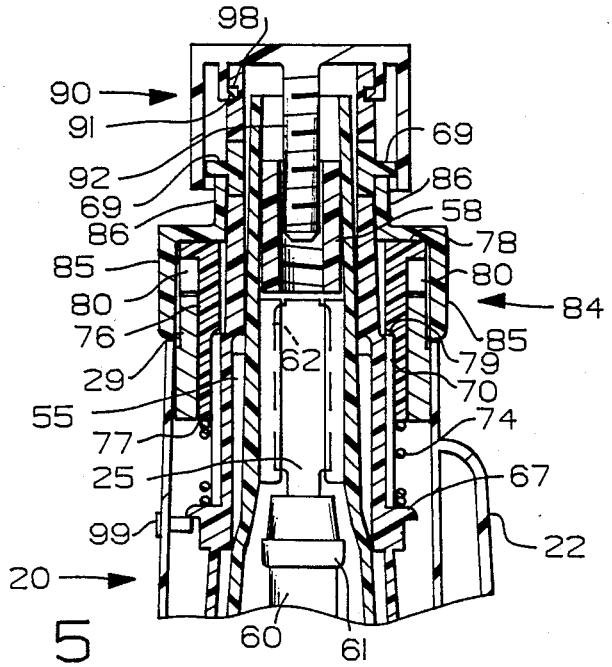
FIG. 5 is a fragmentary, enlarged cross-sectional view of the agitator drive system of FIG. 2 but illustrating the intermediate member in a different position.

In order to provide for full energy input to the load of fabrics the cap 84 is rotated so that the pins 69 are brought to the highest point of the ramps 87. This depresses cap 84 and intermediate member 75, compressing spring 74 and causing teeth 80 to engage with teeth 82. In this configuration, which is shown in FIG. 5, agitator 20 is locked to intermediate member 75, which is locked to adjustment member 64 through the engagement of splines 79 with splines 70 while the adjustment member 64 is locked to the drive member 50 through engagement of the splines 71 with the splines 55, and the drive member 50 is locked to the drive shaft 25 by the engagement of splines 62 with splines 54. Thus the agitator is locked to the drive shaft for conjoint oscillation.

Figure 9:
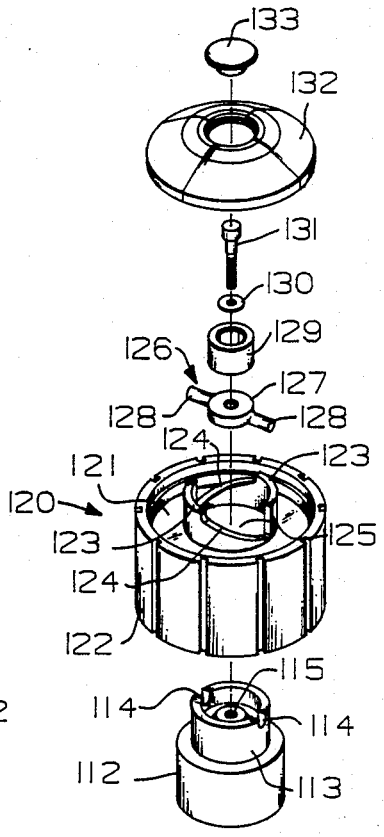
FIGS. 9 is a partial exploded perspective view of the agitator drive system of the embodiment of FIGS. 7 and 8.
Figures 7, 8:
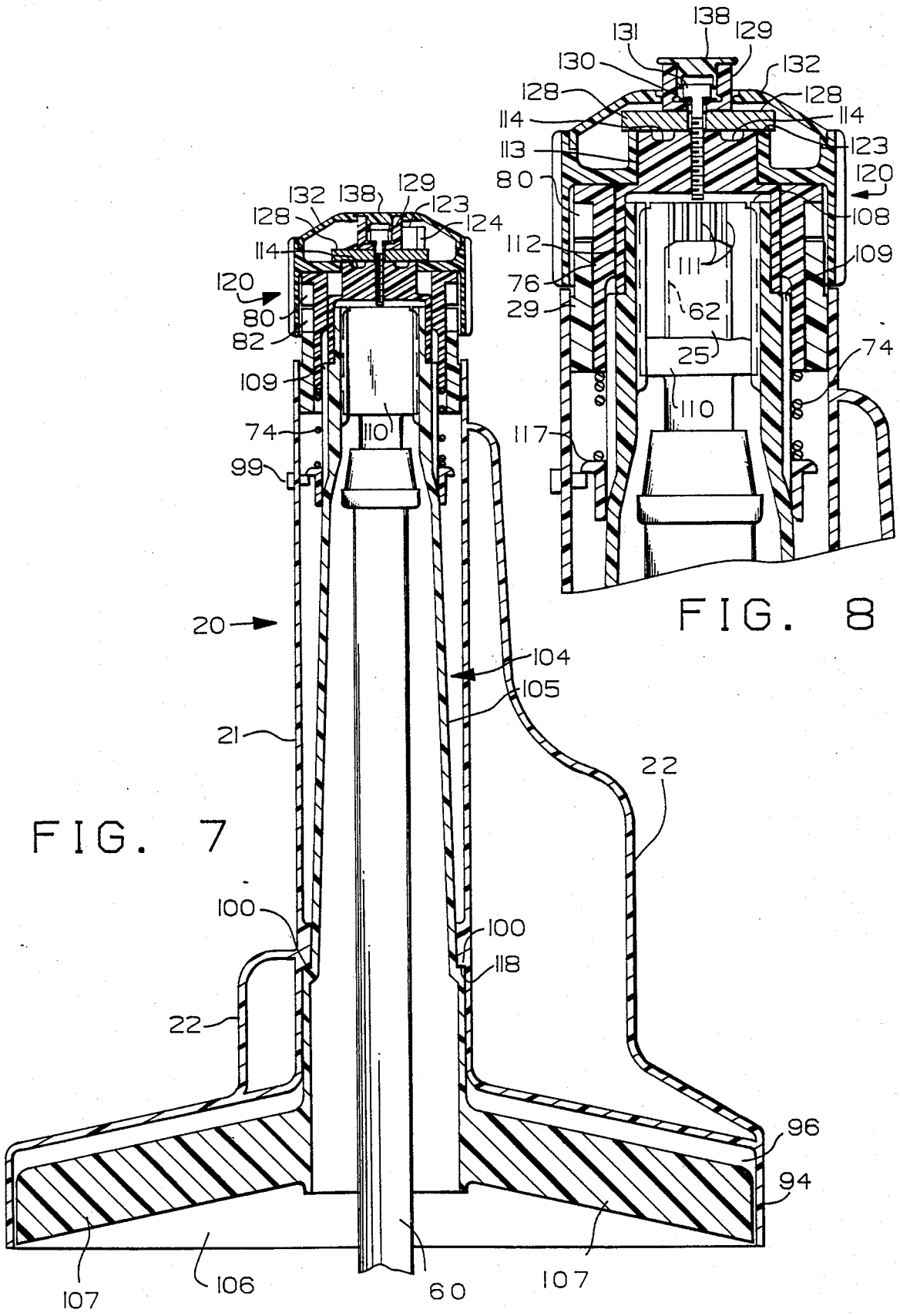
FIG. 7 is a simplified cross-sectional view of an agitator drive system in accordance with another embodiment of the present invention.
FIG. 8 is a fragmentary, enlarged cross-sectional view of the agitator drive system of FIG. 7.

FIGS. 7, 8 and 9 illustrate an adjustable agitator drive system incorporating another embodiment of the present invention. With the drive system or assembly shown in these figures the drive member and agitator selectively are coupled by a lost motion fluid drive or are mechanically connected for conjoint oscillation. However, the spacing between the paddles and the skirt of the agitator is not adjustable so the effectiveness of the fluid drive is not adjustable.

As in the earlier described embodiment the drive shaft 25 extends through tube 60 with its upper portion supported by tube 60 through bearing and seal arrangement 61. The end of the shaft 25 above tube 60 is provided with splines 62. The agitator 20 conveniently may be of the same construction as that of the earlier described embodiment, including a centerpost 21, arcuate vanes 22, and outwardly flared skirt 23 with a depending flange 94 forming pockets or recesses 96. The interior of the centerpost 21 has a lower ledge 100. An upper agitator extension 29 is formed with upwardly facing teeth 82.

In the embodiment of FIGS. 7–9 the adjustment member is omitted and the drive member has a slightly different configuration. Drive member 104 includes a generally vertical cylindrical centerpost 105 with an outwardly extending skirt 106 formed at its lower end. The skirt has formed thereon two upwardly projecting paddles 107. The upper end of centerpost 105 is formed with plurality of longitudinally or axially extending splines 108 formed on its inner surface and a plurality of longitudinally extending splines 109 formed on its outer surface. A shock absorbing liner 110 is positioned within the upper end of the drive member centerpost 105 and is firmly held in place by innerleaving with the splines 108. The inner surface of the liner 110 is formed with a plurality of inwardly projecting axially extending splines 111 which slidably engage splines 62 at the top of drive shaft 25 for mounting the drive member 104 to the drive shaft 25 for conjoint oscillation.

A cap like extension 112 is joined to the top of the drive member 104 above the exterior splines 109 and extends above and over the drive member to close the top of drive member. As best seen FIG. 9, the cap 112 includes an upwardly extending flange 113, having a pair of oppositely disposed indentations 114 and a central threaded bore 115.

A ledge 117 is formed around the outer perimeter of the centerpost 105 at the base of the splines 109 and a ledge 118 is formed adjacent the lower end of the centerpost 105 above the skirt 106. When the agitator 20 is inserted around the drive member 104 the agitator ledge 100 rests on the drive member ledge 118 and pins 99 are inserted through the agitator centerpost 21 just under the ledge 117. Thus the agitator is constrained from axial movement relative to the drive member.

The intermediate or connection member 75 may be of the same configuration as in the earlier described embodiment, having a cylindrical body 76, lower rim 77 and an upper edge 78. Splines 79 are formed on the inner surface of cylindrical body 76 for sliding engagement with splines 109 on the outer surface of the drive member 104. Downwardly facing or opening teeth 80 are formed under the upper edge 78 for selective engagement with the upwardly facing teeth 82 of the agitator. When the intermediate member is mounted over the drive member 104, a spring 74 is positioned between the ledge 117 and the lower edge or rim 77 to bias the intermediate member 75 upwardly, as seen in FIGS. 7 and 8.

A cap 120 has top 121, an axial skirt 122 and an upwardly extending collar 123. The collar 123 is provided with a pair of oppositely disposed ramps 124 and a central opening or bore 125.

As best seen in FIG. 9, the assembly is completed by a connector 126 having a central body 127 and a pair of outwardly extending ends or pins 128; a cup 129; a washer 130; attachment screw or bolt 131; a cover ring 132; and a cover cap 133.

In assembling the adjustable drive system of this embodiment, the drive member 104 is placed over the drive shaft 25 with the splines 111 interfitting with the splines 62 so that the drive member is joined to the drive shaft for conjoint oscillation therewith. The agitator is placed over the drive member with the ledge 100 resting on the ledge 118 and pins 99 are inserted into the agitator so as to be just under the ledge 117. The coil spring 74 is placed over the drive member 104 and within the agitator 20 and rests on the upper surface of the ledge 117. The intermediate member 75 is placed over the upper end of the drive member 104 and the lower edge or rim 77 rests on the upper end of the spring 74. The cap 120 is placed over the intermediate member 75 with the ramps 124 aligned with the indentations 114 in the drive member extension 112 and is pushed downwardly so that the indentations 114 are exposed. The connector 126 is placed on top of the extension 112 with the pins 128 received in the indentations 114 and extending across the ramps 124. The screw or bolt 131 is inserted through the washer 130 and the cup 129 and the opening in the body 127 of the connector 126 and is threaded into the bore 115 of drive member extension 112. Finally the cap 133 is placed in the top of cup 129 and the ring 132 is placed within the skirt 122.

With this assembly the drive member 104 is mechanically joined to drive shaft 125 by the cooperation of the splines 62 and 111. The engagement of splines 79 and 109 join the intermediate member 75 to the drive member 104 for conjoint oscillation while at the same time permitting the teeth 80 and 82 selectively to be engaged (as shown in FIG. 8) or to be disengaged (as shown in FIG. 7). When the teeth are engaged or interleaved the agitator is mechanically connected or locked to the drive member through the intermediate member for conjoint oscillation therewith, and thus with the drive shaft. When the teeth 80 and 82 are not interleaved the paddles 107 moving within the recesses 96 provide a lost motion fluid drive from the drive member to the agitator.

The cap 20 is used to change the mechanism from a mechanical drive to a fluid drive. When the cap 120 is rotated in the counterclockwise direction, as seen in FIG. 9, the pins 128 ride up the ramps 124 and thus force the cap 120 to move axially downward relative to the drive member 104. This brings the teeth 80 downward into interleaved engagement with the teeth 82. When the cap 120 is rotated in the clockwise direction, as seen in FIG. 9, the pins 128 move to the lower portion of the ramps 124 and permit the cap 120 and intermediate member 75 to move axially upwardly, as seen in FIG. 7 and 8, so that the teeth 80 disengage from the teeth 82. When cap 120 is down, cup 129 extends above ring 133 (as seen in FIG. 8) and, when cap 120 is up, cup 129 and cover 133 are flush with ring 132. Thus cup 120 acts as a signal informing the user of the setting of the drive system.

It will be understood that a number of individual pieces are joined together to form unitary structures. For example the ledge 117 is permanently attached to the centerpost 105 of drive member 104, ledge 67 is permanently attached to adjustment member 64; extension 29 is permanently attached to agitator 20, extension 112 is permanently attached to dive member 104 and extension 112 is permanently attached to drive member 104. Whether parts such as these are formed separately and attached to the corresponding larger components or are formed integrally with the larger components is a matter of choice.

What is claimed is:

1. A fabric washing machine, including:

liquid and fabric containing means;

an agitator positioned in said containing means and movable therein to provide washing energy to the liquid and fabrics in said containing means;

agitator drive means having an oscillating motion of predetermined magnitude;

corresponding portions of said agitator and said agitator drive means being adapted to be immersed in liquid contained in said containing means and forming a lost motion fluid drive therebetween utilizing liquid in said containing means; whereby, upon oscillation of said drive means through a predetermined arc length, oscillation of said agitator will be through a shorter arc length.

2. A fabric washing machine as set forth in claim 1, wherein said lost motion fluid drive between said agitator drive means and said agitator is selectably adjustable to adjust the agitator oscillation arc length responsive to a drive means oscillation of predetermined arc

3. A fabric washing machine as set forth in claim 1, wherein:

each of said agitator drive means and said agitator is mounted for oscillation about a generally vertical axis;

said agitator drive means includes a skirt projecting generally outward of the vertical axis and positioned to be immersed in liquid in said containing means;

said agitator includes a skirt projecting generally outward of the vertical axis, spaced axially from said agitator drive means skirt and positioned to be immersed in liquid in said containing means;

one of said skirts is provided with at least one recess facing the other of said skirts and the other of said skirts is provided with at least one paddle received in said at least one recess;

whereby oscillation of said agitator drive means causes relative motion between said paddle and recess to provide lost motion fluid drive of said agitator.

4. A fabric washing machine as set forth in claim 1, further including means for selectively connecting said agitator and said agitator drive means for conjoint oscillation independent of said lost motion fluid drive.

5. In a fabric washing machine having liquid and clothes containing means and an agitator positioned in said containing means and movable therein to impart washing energy to the liquid and clothes therein; an adjustable agitation system comprising:

means having an oscillating motion;

an intermediate member mounted to said drive means for oscillation therewith and being selectably movable between first and second axially separated positions relative to said drive means;

connection means effective, when said intermediate member is in its first axial position, to connect said agitator to said agitator drive means for conjoint oscillation and effective, when said intermediate member is in its second axial position, to disconnect said agitator from said agitator drive means.

6. The apparatus as defined in claim 5 further comprising spring means biasing said intermediate member to one of its axial positions and manually operable means for moving said intermediate member to the other of its axial positions.

7. The apparatus as defined in claim 5, wherein said agitator and said agitator drive means have corresponding portions adapted to be immersed in liquid contained in said containing means and forming a lost motion fluid drive therebetween utilizing liquid in said containing means so that, when said intermediate member is in its second axial position, oscillation of said agitator drive means through a predetermined arc will cause said agitator to oscillate through a shorter arc.

8. In an automatic washing machine of the vertical axis type having container means to receive liquid and fabrics, an adjustable agitation system comprising:

elongated agitator drive means mounted for oscillation about a generally vertical shaft in said container means and including an outwardly flared skirt adapted to be immersed in liquid in said container means;

an elongated agitator positioned over said agitator drive means and mounted for oscillation about a generally vertical shaft; said agitator including an outwardly flared skirt adapted to be immersed in liquid in said container means in close proximity to said agitator drive means skirt;

manually selectable means for selectively connecting said agitator to said agitator drive means for conjoint oscillation and disconnecting said agitator from said drive means; and means forming a lost motion fluid drive between said agitator and said agitator drive means so that, when said manually selectable means has disconnected said agitator from said agitator drive means, oscillation of said agitator drive means through an arc of predetermined length will cause said agitator to oscillate through a shorter arc.

9. The apparatus defined in claim 8, further comprising manually operable means for varying the effectiveness of said fluid drive to vary the arc length of agitator oscillation responsive to a predetermined arc length of agitator drive means oscillation.

10. The apparatus defined in claim 9, wherein the lost motion fluid drive is formed between said skirts of said agitator drive means and agitator and said manually operable means is effective to vary the spacing between said skirts.

11. In an automatic washing machine having container means to receive liquid and fabrics to be washed in the liquid, an adjustable agitation system comprising:

an elongated drive member oscillatable about a generally vertical axis, said drive member including a longitudinally splined section;

an elongated agitator mounted over and spaced from said drive member for oscillation about the generally vertical axis, said agitator including a toothed section;

an intermediate member positioned between said drive member and said agitator, said intermediate member including a longitudinally splined section mating with said drive member splined section, said intermediate member also including a toothed section positioned for selective engagement with said agitator toothed section;

means for selectively moving said intermediate member longitudinally between a first position in which its toothed section engages said agitator toothed section for conjoint oscillation of said drive member and said agitator and a second position in which its toothed section is disengaged from said agitator toothed section;

said drive member having an outwardly extending skirt positioned to be immersed in the liquid;

said agitator having an outwardly extending skirt positioned to be immersed in the liquid and spaced from said drive member skirt; and means forming a lost motion fluid drive between said skirts so that, when said intermediate member is in its second position, oscillation of said drive member through a predetermined arc causes oscillation of said agitator through a lesser arc.

12. The apparatus as set forth in claim 11, wherein:

said means for selectively moving said intermediate member includes spring means biasing said intermediate member to one of its positions and manually operable means for moving said intermediate member to the other of its positions.

13. The apparatus as set forth in claim 12, wherein: said spring means is positioned between said drive member and said intermediate member and biases said intermediate to its second position and said manually operable means is selectively effective to move said intermediate member to its first position.

14. The apparatus as set forth in claim 11 wherein:

one of said skirts is provided with at least one generally arcuate recess facing the other of and said skirts and the other of said skirts is provided with at least one paddle received in said at least one recess and spaced from said one skirt to permit said at least one paddle to oscillate within said at least one pocket to provide the lost motion fluid drive between said drive member and agitator.

15. The apparatus as set forth in claim 14, wherein:

the underside of said agitator skirt is provided with at least two generally arcuate recesses, each of said recesses being at least substantially the arcuate length of oscillation of said drive member; and the upper drive surface of said drive member skirt is provided with at least two generally radially extending paddles, each of which is received in a corresponding recess.

16. In an automatic washing machine having container means to receive liquid and fabrics to be washed in the liquid, an adjustable agitation system comprising:

an elongated drive member oscillatable about a generally vertical axis and having an outwardly extending skirt positioned to be immersed in the liquid;

an elongated agitator mounted over and spaced from said drive member for oscillation about the generally vertical axis; said agitator having an outwardly extending skirt spaced from said drive member skirt and positioned to be immersed in the liquid;

one of said skirts being provided with a least one generally arcuate recess facing the other of said skirts and the other of said skirts being provided with at least one generally radially extending paddle received in said at least one recess and spaced from said one skirt to permit said at least one paddle to oscillate within said at least one recess so that oscillation of said drive member through a predetermined arc results in oscillation of said agitator through a lesser arc; and manually operable adjustment means to selectively vary the spacing between said at least one skirt and said at least one paddle for varying the arc length of agitator oscillation in response to a predetermined arc length of drive member oscillation.

17. The apparatus as set forth in claim 16, wherein:

said adjustment means includes an elongated adjustment member mounted between said drive member and said agitator and connected to said agitator for conjoint longitudinal movement therewith; and manually operable means for varying the longitudinal position of said adjustment member relative to said drive member.

18. The apparatus as set forth in claim 17, wherein:

said drive member has a longitudinally splined section on its outer surface; said adjustment member has a longitudinally splined section on its inner surface mating with said drive member splined section to provide for conjoint oscillation of said drive member and said adjustment member and for relative longitudinal movement between said adjustment member and said drive member;

said adjustment member also has a longitudinally splined section on its outer surface;

said agitator is provided with a toothed section;

an intermediate member is positioned between said adjustment member and said agitator, said intermediate member has a longitudinally splined section on its inner surface mating with said adjustment member outer splined section to provide for conjoint oscillation of said adjustment member and said intermediate member and relative longitudinal movement between said intermediate member and said adjustment member, said intermediate member also has a toothed section positioned for selective engagement with said agitator toothed section;

means is provided for selectively moving said intermediate member longitudinally between a first position with its toothed section engaged with said agitator toothed section for conjoint oscillation of said drive member and said agitator, and a second position with said intermediate member toothed section disengaged from said agitator toothed section.

19. The apparatus as set forth in claim 18, wherein:

said means for longitudinally moving said intermediate member includes spring means positioned between said adjustment member and said intermediate member and biasing said intermediate member toward its second position and manually operable means for moving said intermediate member to its first position.

* * * * *

UNITED STATES PATENT AND TRADEMARK OFFICE

CERTIFICATE OF CORRECTION

PATENT NO. : 4,920,770

DATED : May 1, 1990

INVENTOR(S) : Eddie W. Dooley and Joseph R. Noland

It is certified that error appears in the above-identified patent and that said Letters Patent is hereby corrected as shown below:

Col. 10, Line 2, after "arc" insert the word --length--.

Col. 10, Line 33, before "means" insert the words --agitator drive--.

Col. 12, Line 17, delete "upper drive" and substitute therefor --upper--.

Signed and Sealed this

Second Day of July, 1991

*Attest:*

HARRY F. MANBECK, JR.

*Attesting Officer*

*Commissioner of Patents and Trademarks*